US006415551B1

(12) United States Patent
Norman

(10) Patent No.: US 6,415,551 B1
(45) Date of Patent: Jul. 9, 2002

(54) NON FRICTION DIRECT DRIVE POWERED TELESCOPING BLEACHER SEATING SYSTEM

(75) Inventor: Dennis Norman, Willis, TX (US)

(73) Assignee: Specialty Supply & Installation Company, Conroe, TX (US)

( * ) Notice: Subject to any disclaimer, the term of this patent is extended or adjusted under 35 U.S.C. 154(b) by 0 days.

(21) Appl. No.: 09/467,958

(22) Filed: Dec. 21, 1999

(51) Int. Cl.[7] ..... E04H 3/12

(52) U.S. Cl. ..... 52/10; 52/9; 52/64; 180/251; 318/466

(58) Field of Search ..... 52/9, 10, 64; 180/251; 318/466

(56) References Cited

U.S. PATENT DOCUMENTS 3,052,929 A * 9/1962 Busse ..... 20/1.126
3,738,612 A * 6/1973 Hartman ..... 254/1
3,881,140 A * 4/1975 Hartman ..... 318/85
4,285,172 A * 8/1981 Quigley ..... 52/10
5,365,704 A * 11/1994 Ray ..... 52/64
5,467,840 A * 11/1995 Becher et al. ..... 180/251
5,559,411 A * 9/1996 Winship ..... 318/466

* cited by examiner

*Primary Examiner*—Carl D. Friedman
*Assistant Examiner*—Christy M. Syres
(74) *Attorney, Agent, or Firm*—Wendy K. Buskop; Buskop Law Group, P.C.

(57) ABSTRACT

A non friction motor driven telescoping row based seating system having a direct drive motor apparatus for engaging a drum which winds and unwinds interconnected drive carriages on said drum to provide telescoping and retraction movement to the seating system.

9 Claims, 8 Drawing Sheets

NON FRICTION DIRECT DRIVE POWERED TELESCOPING BLEACHER SEATING SYSTEM

BACKGROUND OF THE INVENTION

The present invention relates to a power system for a telescoping bleacher seating system and more particularly, to an improvement in the method for extending and retracting bleacher seats.

Telescoping seating systems are well-known in the art, and generally include a plurality of benches, each bench having a seating frame or understructure including columns or posts extending vertically from a base on wheels, to the height of a given bench.

Telescoping seating systems can be bench seating systems or seating systems which have individual seat supported on benches, such as for stadium or convention center seating.

Non friction drive systems do not frictionally engage the floor, but instead include an extendable chain that extends from a power drive mechanism positioned at the rear of the telescopic seating structure. Further the extendable chains if not properly adjusted can cause the telescopic seating to extend non-linearly. This condition can cause the extendable chair and/or the telescopic seating to skew, resulting in alignment difficulties. Under extreme conditions, non-linear extension may cause the chain to deform, particularly at the outermost end of the chain where the chains are the weakest and experience the greatest stress. Known extendable chains and the mechanisms for driving them also tend to be quite complex and sensitive to wear, such that they require constant maintenance and adjustment to keep them in proper working condition. A need has long existed for a system, which requires less maintenance in the field, and less sensitivity to stress.

Power systems are used to move the telescoping benches between the use and storage positions. One such power system is disclosed in U.S. Pat. No. 4,285,172. Despite the convenience and labor savings provided by such power systems, a need has existed for safer power systems, which do not require the use of chains, or sprockets, which can engage fingers and break or rip human flesh.

A principal object of the present invention is to provide a non friction power system for bleacher type seating which is expandable and collapsible for storage, which utilizes a direct drive system without the need for chains or sprockets.

Another object of the present invention is to provide a non friction stadium seating system which installers can simply and easily place in the field without the need for additional and expensive welding of the units.

Still a further object of the present invention is to provide a motor which is of a lower horse power but of a higher torque and is capable of moving at least 20 or even more rows of bleachers but using less energy than in the past.

Other features and advantages of the present invention will be apparent from the following drawings wherein identical reference numerals will be used to refer to like parts of the various views.

SUMMARY

The present invention relates to a telescopic seating system, comprising seats disposed on a frame, which is operably connected to a motor system,. Further, it includes a plurality of interconnected drive carriages adapted for connection to a telescopic seating system to extend and retract the telescopic seating system, drive carriages being configured to selectively mateably wind onto and off from the drum as the drum is rotated. The motor system comprises a drum, a drum frame, at least two drum shafts rotatably engaged to said drum. The power mechanism is attached to the drum frame further having a motor attached to a motor frame, at least two motor shafts extending from each side of said motor, and a drive shaft connected to the motor shafts. The drip means enables the motor to rotate the drum and thereby extend and retract drive carriages which move the seats, and wherein the motor and drum engage the drive carriages so that the drive carriage move in substantially continuously tangentially alignment as the drive carriages are selectively retracted and extended by the drum.

THE DRAWINGS

These and other features, advantages and objects of the present invention will be further understood and appreciated by those skilled in the art by reference to the following specification, claims and appended drawings.

DETAILED DESCRIPTION

Figure 1:
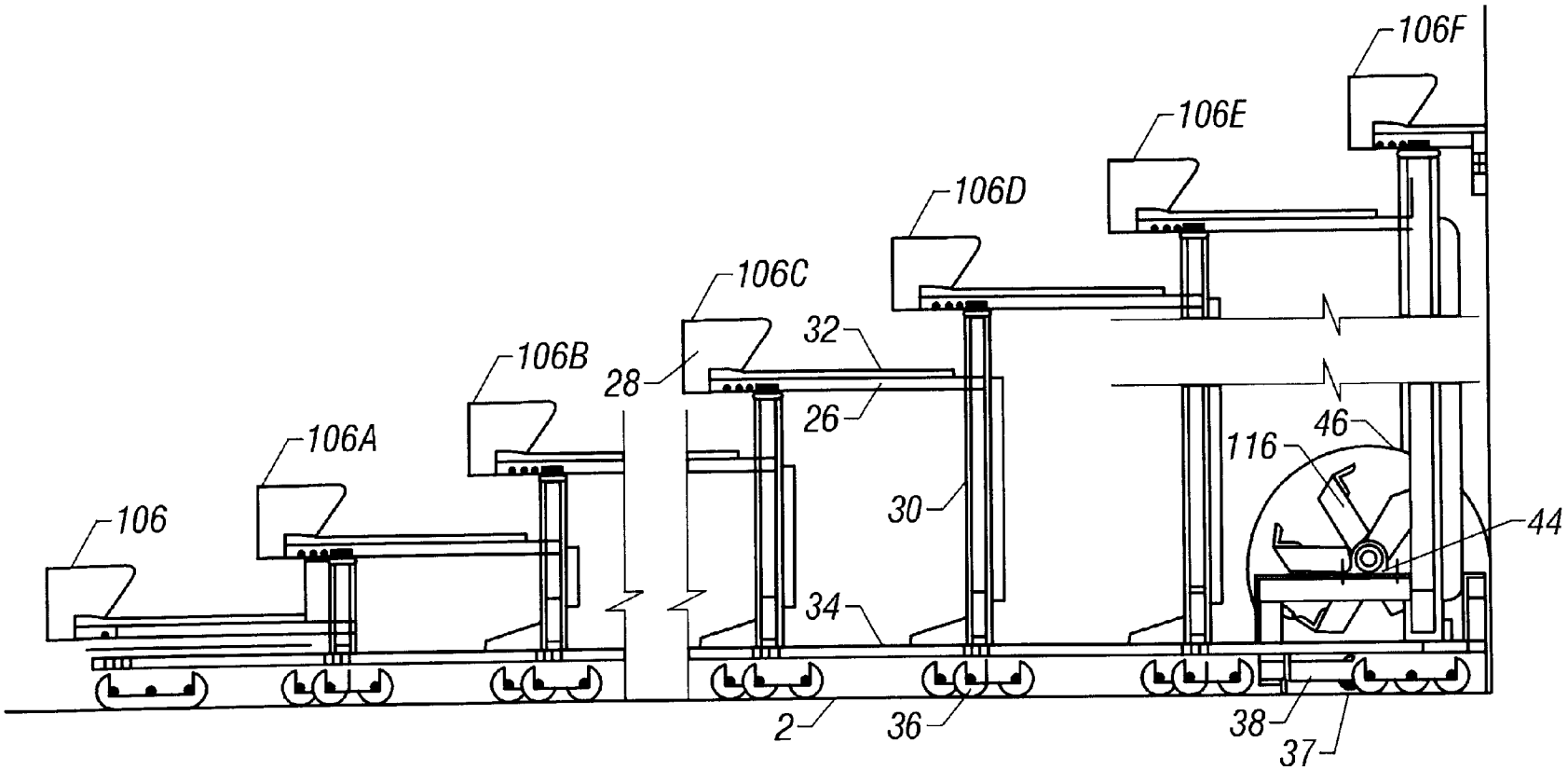
FIG. 1 is a side view of the bleacher seats in an extended position.

FIG. 1 depicts the unique telescoping seating system 100 which is the combination of the non friction direct drive power system and an embodiment of the bench seating components having seven components, 106, 106A, 106B, 106C, 106D, 106E and 106F.

Sections 106, 106A, 106B, 106C, 106D, 106E and 106F include complementary components that are folded into each other, as are generally known in the art, thus only one section is described herein. A seating frame 24 is mounted by means of a stanchion bracket 26 to the deck portion 28 of a bench. Seat 28 is attached to a cantilever arm 26, which attaches to column 30. Column 30 attaches to foot 34. Decking material 32 is detachably engaged to the cantilever arm 26. A set or a bench can be attached to the decking material 32. Foot 34 has wheels 36 for carrying the load of the bleaches directly to the floor 2.

Telescoping seating 110 includes a plurality of sections operably interconnected for telescoping collapsible movement. In FIG. 1, 7 sections are shown, however it is contemplated that many sections can be sued with the non friction direct drive system. Further other seating systems that re known in the art can be used with the direct drive power system. Thus the seating disclosed herein is for illustrative purposes only and is not intended to be unnecessarily limiting.

Figure 2:
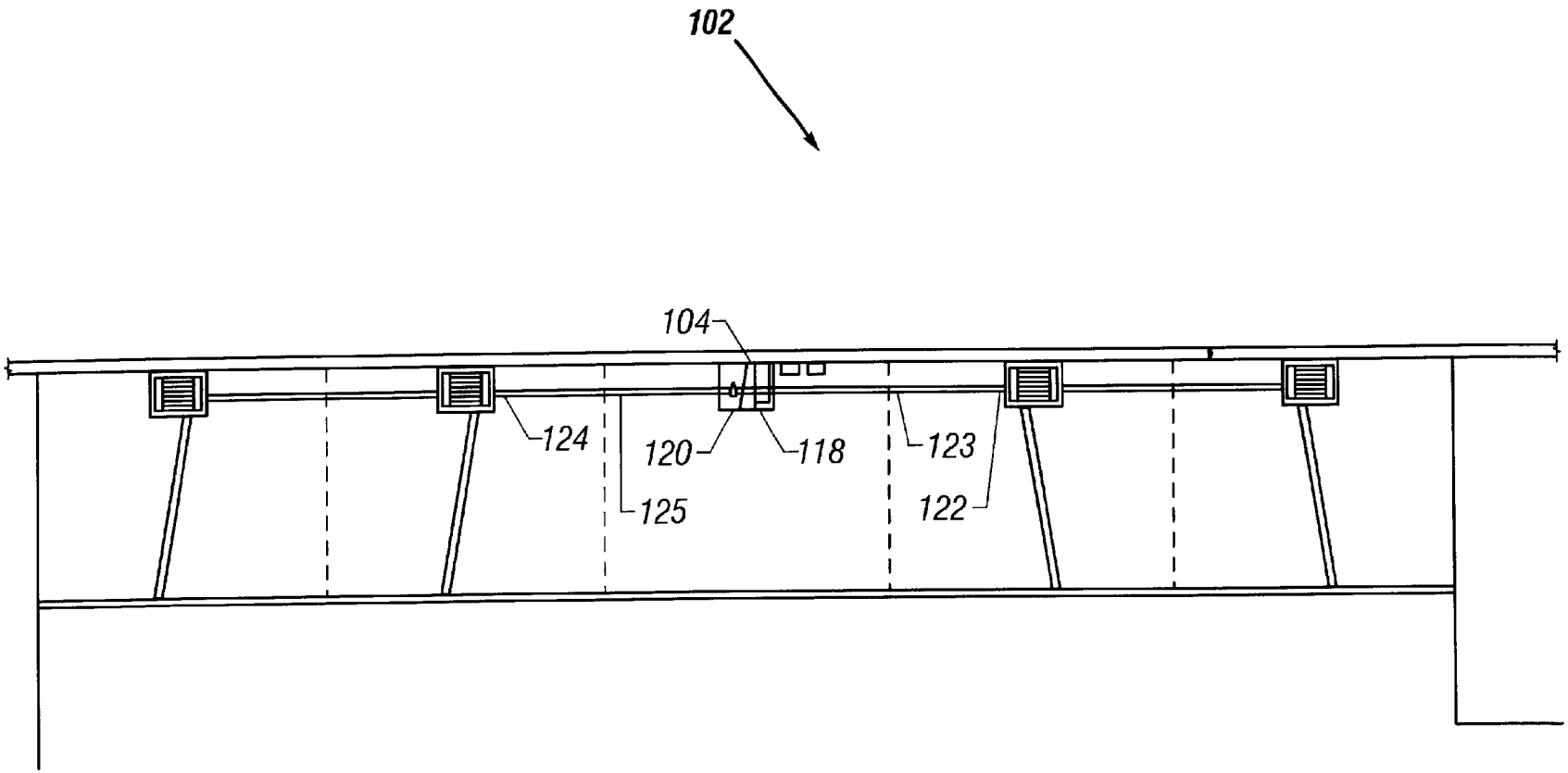
FIG. 2 is a top view of the novel direct drive power system using a plurality of drums.
Figure 4:
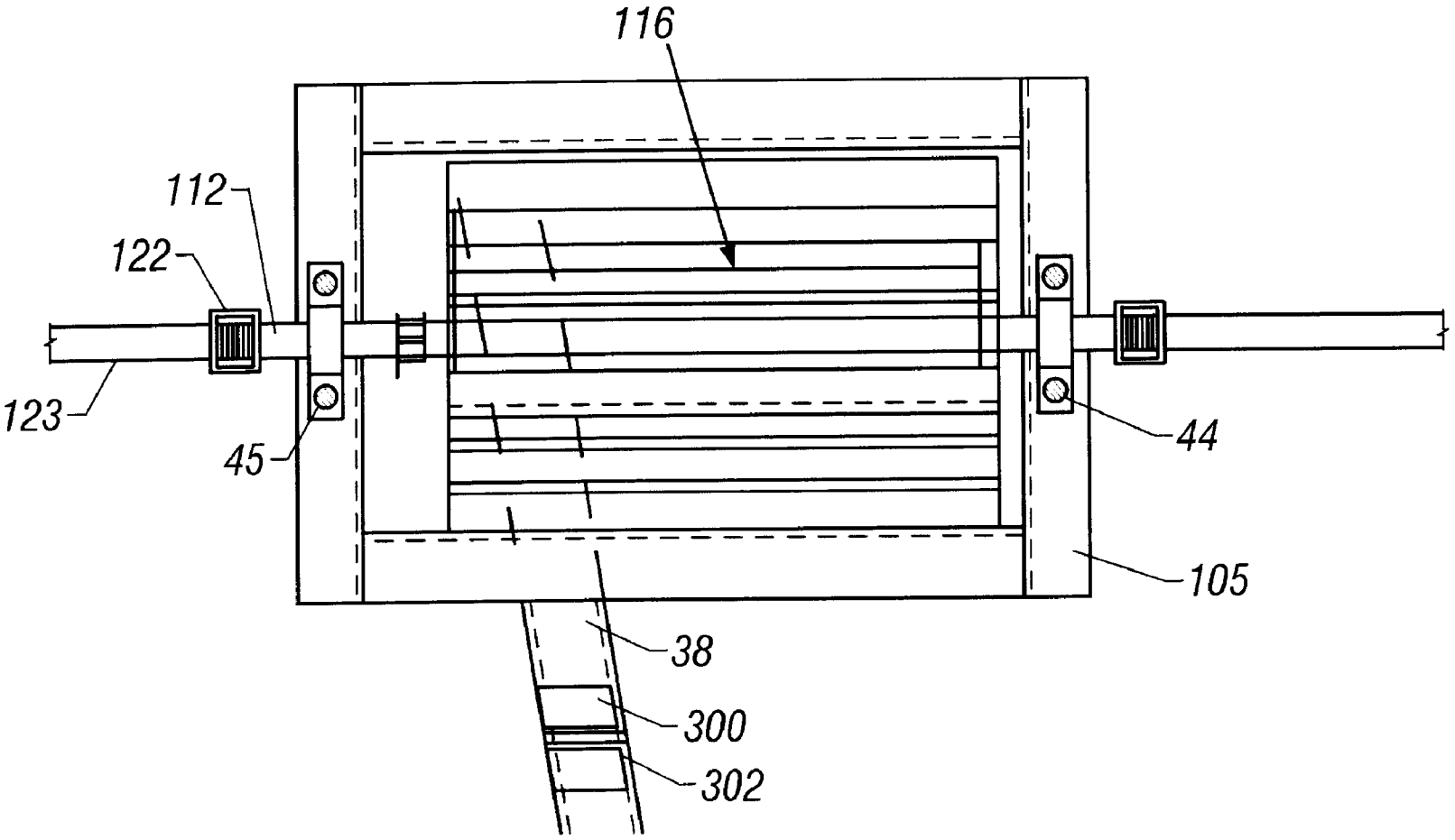
FIG. 4 is a top view of a drum.

FIG. 2 depicts a direct drive power system 102 embodying the present invention is provided for in FIGS. 2 and 4 for extending and retracting telescopic or folding seating, such as benches or individual chairs deployed on benches.

Returning to FIG. 2, the direct drive power system 102 includes a motor 104, operably mounted on a motor frame 103 which is attached to the seating components 106. Drum 116 is connected via drive shaft 123 to motor 104 via shaft coupler 120 and motor coupler 118 and coupler 122 provides the connection. Drum 117 is connected via drive shaft 125 to motor 104.

Figure 3:
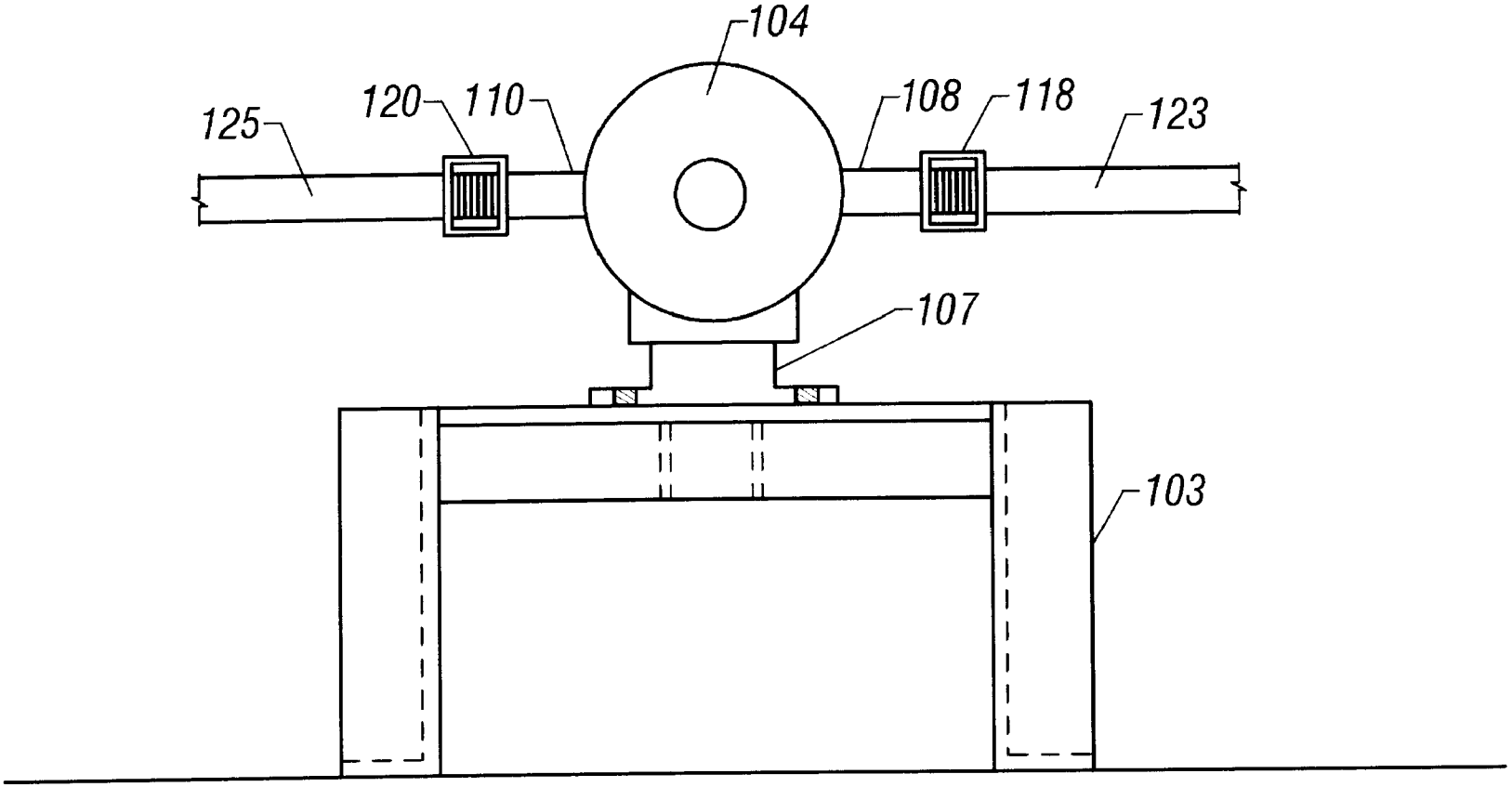
FIG. 3 is a front view of a drum.

At least four shaft couplers are contemplated for use within the scope of the present invention, motor coupler 118, shaft coupler 120, drum shaft coupler 122, and shaft coupler 124. Additional shaft couplers could be used, depending on the overall length of the telescoping seating to be used FIG. 3 shows that motor 104 has first motor shaft 108 and second motor shaft 110 operably connected to motor 104. First motor shaft 108 operable connects to drive shaft 123 via motor coupler 118. Second motor shaft 110 connects to the drive shaft 125 via coupler 120. Motor 104 is supported by motor flanges 107 mounted on motor frame 103.

Typical stock couplings available from Martin can be used in this invention. Most preferably, couplings which are prebored, 1 and ¼ inch couplings having a keyway cut into the coupling, such as the Martin model 5018 are usable herein. Other types of couplings could be used, such as model L090-500 available from Lovejoy.

FIG. 4 shows that drum shaft 112 is operatively connected to a first drum 116. Drum shaft 112 connects to coupler 122, which connects to drive shaft 123. All parts are supported on a drum frame 105.

Figure 5:
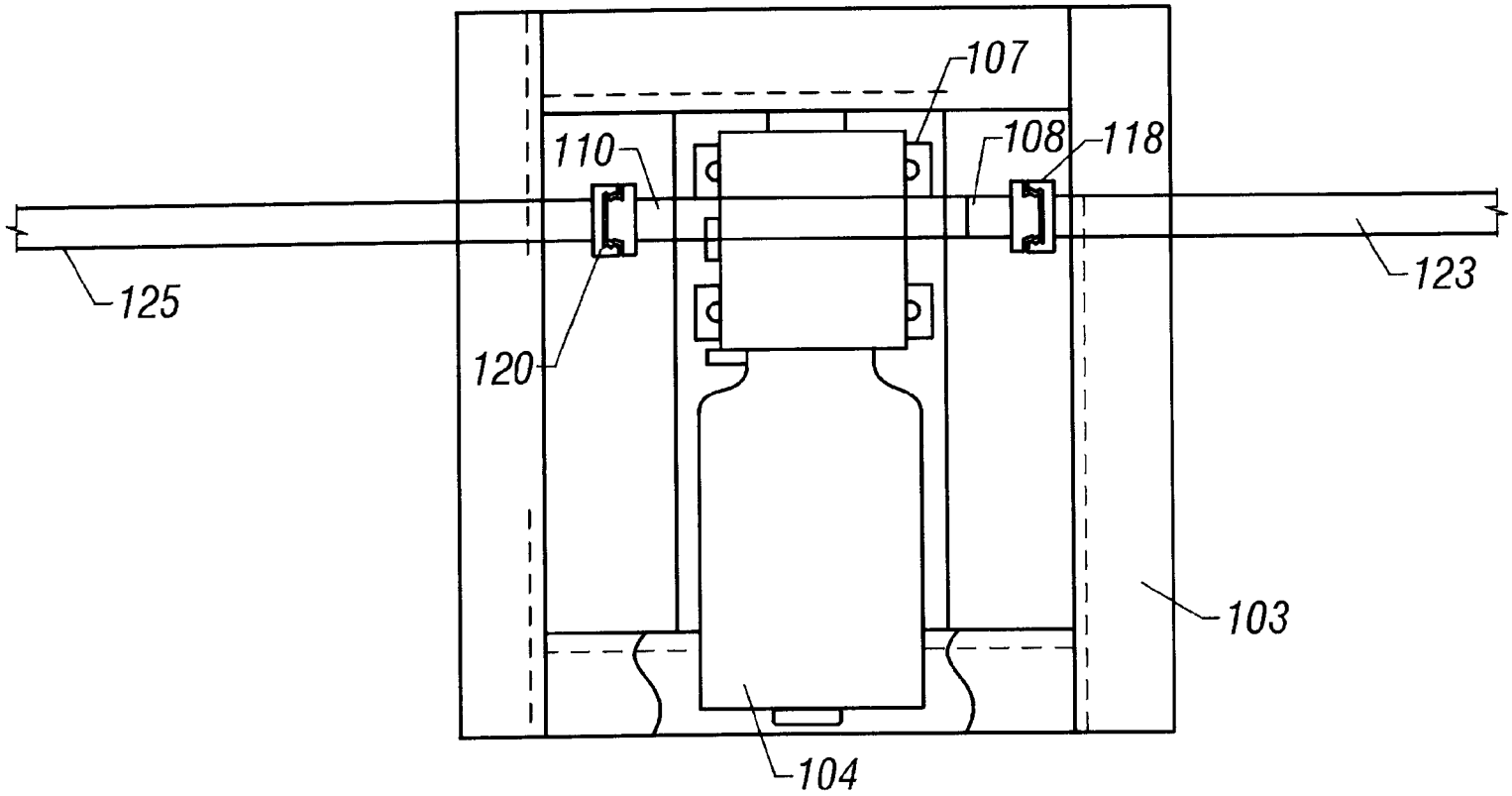
FIG. 5 is a top view of a power system.

FIG. 5 shows first motor shaft 108 connected to motor coupler 118. Motor coupler 118 connects to drive shaft 123. Motor shaft 110 is coupled via motor coupler 120 to connect with drive shaft 125. Motor frame 103 supports motor 104 with motor flange 107.

Figure 6:
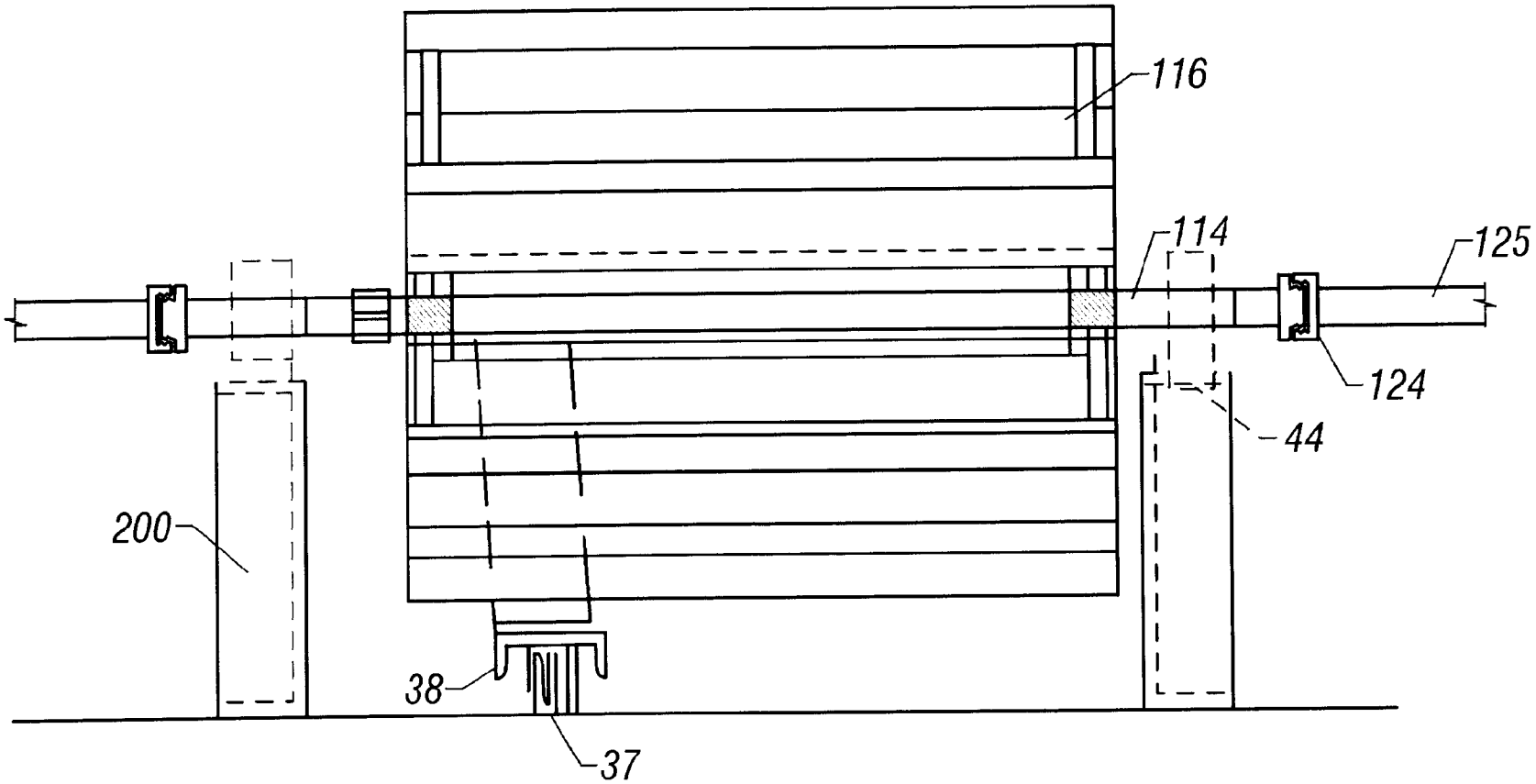
FIG. 6 is a front view of a drum.

FIG. 6 shows drum 117 having drum shaft 114 connected to coupler 124, which ties to drive shaft 125. Drum 117 rests on drum frame 200.

Figure 7:
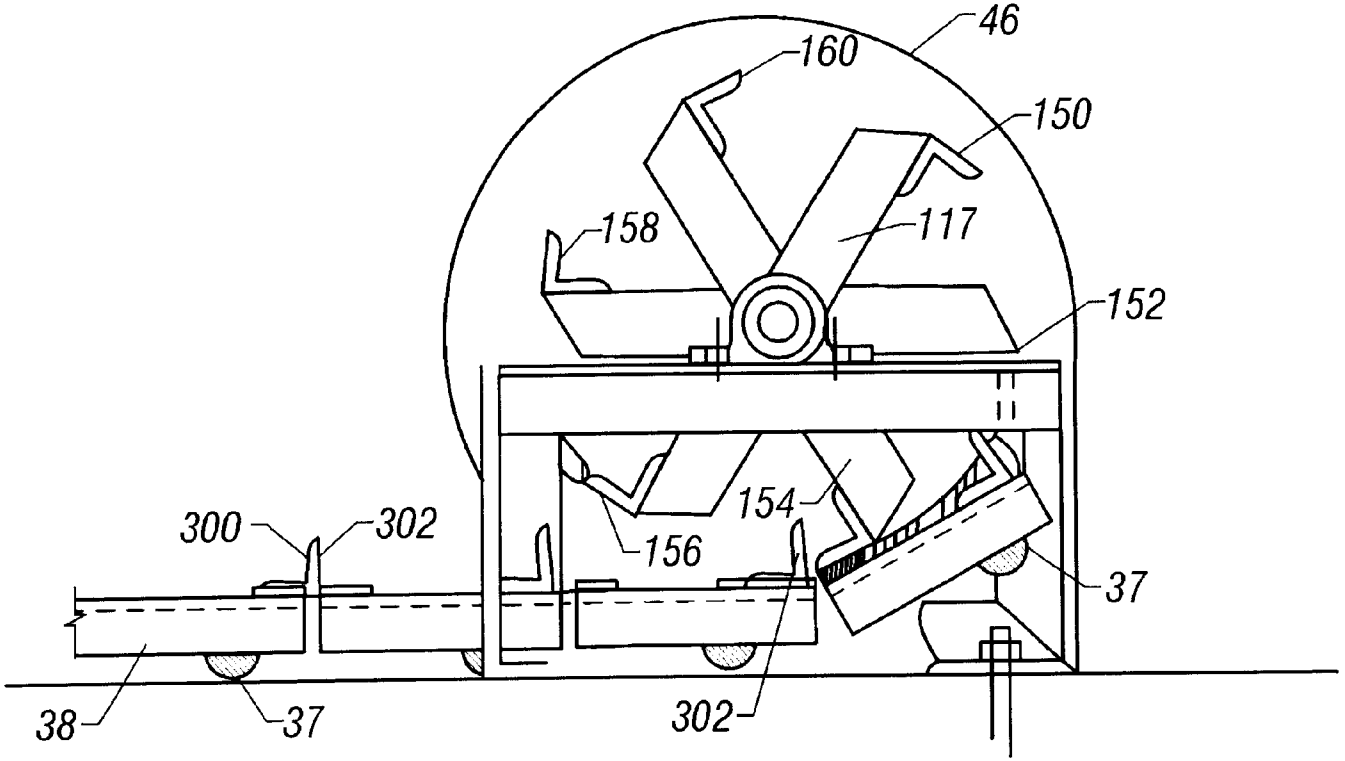
FIG. 7 is a side view of a drum.
Figure 8:
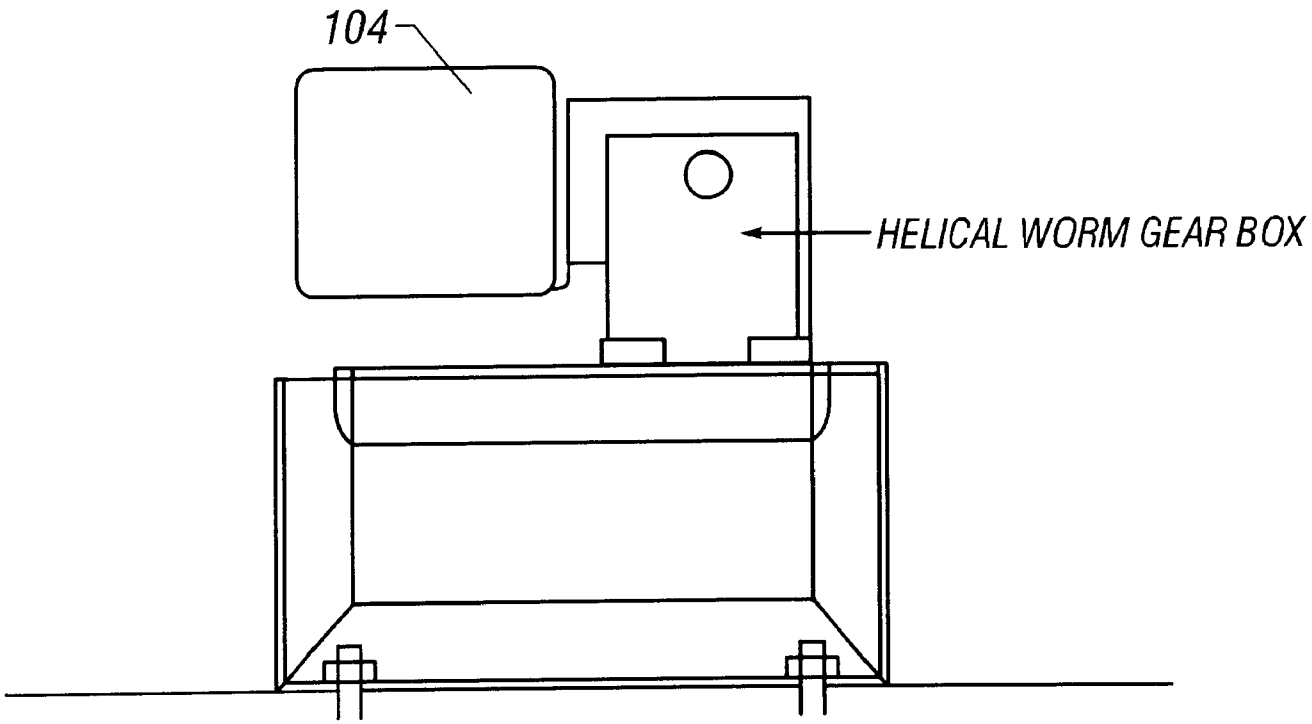
FIG. 8 is a side view of a motor.

In FIG. 7, drum 117 is a six-sided structure defining a plurality of flat sides around its perimeter for mateably receiving a plurality of drive carriages 38 with casters 37 attached to the carriages. Drum 117 is narrow enough to fit in the back row of the bleacher seating system. Drum 117 has a drum shroud 46 to protect humans from the safety hazards associated with operating this machinery.

In the most preferred embodiment, drum 117 has six sides, 150, 152, 154, 156, 158 and 160 arranged in a spiral type arrangement that are particularly configured to receive drive carriages 38. It is noted that a drum with fewer than six could work within the scope of the present invention. However, a six sided structure is considered the preferred embodiment.

Preferably, each of these sides is arranged 60 degrees apart from each other. Six is considered the optimal number of sides for the drum so that the carriages are pushed out across the surface rather than down into the floor. The six-sided structure reduces the torque on the carriages to move them.

It is noted that an alternative number of sides can be used if desired. The 6 sides define and increasing radial distance relative to the axis defined by the drum shafts, such that the last end of the sixth's side is spaced radially from the first end of the first side by a set radial instance. Radial distances are equal to the thickness of the drive carriages. Each of the sides of a drum, 150, 152, 154, 156, 158 and 160 has an equal length.

Each carriage has a push plate or a "drum engagement plate 302" for engaging the drum. These drum engagement plates are positioned at a force-absorbing angle so that the drum can engage the carriages to pull the drive carriages around the drum, thereby retracting the bench system.

The drive carriages are interconnected using hinges 300 forming a continuous series of interlinked drive carriages. The hinges 300, typically are butt hinges are welded to the drive carriages, although detachable hinging means could be used to connect the drive carriages rather than a welded connecting means. The drive carriages further have an extension welded to them. The drum engagement plate generally forms a right angle to the butt hinge.

Casters 37 are affixed to drive carriages 38. Casters 37 on the bottom of the drive carriages are preferably preassembled casters with wheel size to be a minimum of ⅞" wide×2" tall. Casters 37 preferably, contain flanges, which are welded to the bottom of the drive carriages.

The present invention utilizes interconnected drive carriages fabricated of C channel 4×12×¼". Each drive carriage has a 12" link and a 4×4×3/16" butt hinge and 2 ½×2 ½×¼" angle stop welded to a 2 ½×3/16" flat strip welded on front of angle stop to relieve stress from hinges. It is this angle stop with flat strip, which comprises each of the extensions noted above.

Returning again to FIG. 1, the system is shown in the extended position for use in a gym. The telescoping benches are shown in stepped or tiered relationship with each other. When the bench system is retracted for storage, the benches are generally vertically aligned with a lower bench nested beneath a higher bench. It is contemplated to be within the scope of the present invention, that this concept be applied to telescoping seating systems which have individual chairs mounted on the benches of the seating.

Referring now to FIG. 1, drum 116 is supported on drum pillow block 44 In FIG. 4, pillow blocks 44 and 45 are shown. A drum shroud 46 provides a protective cover so that as drive carriages 38 are rolled up onto the drum 116 so the casters 37 do not provide a safety hazard to people near the bleacher unit.

Drums are preferably six sided units consisting of 3×3×¼" steel angle mounted to a 1 and ¼ inch OD center shaft. Brackets used for mounting angles to the shaft are to be 2×3/16" flat metal segments. The center shaft at each end of the drum is supported by 1 and ¼ inch pillow block with ½×1" slotted holes for adjustment. The drum frames to support the drum are made of 2×2×3/16" angle welded to form to rectangular sides with drum resting between, mounted on top of center support bracket, which is to be off the floor. Drum units are designed to produce at least 1150 torque horsepower. Pillow blocks for the drums are preferably cast iron such as a SAS Standard Series: SAS 1 and ¼ inch shaft OD diameter such as those with model number GYA104RRB.

The motor of the present invention is preferably a reversible direct drive electrical motor can be a NEMA B design, totally enclosed fan-cooled motor with helical/worm double reduction gear, having a 100 to 1 gear ratio power drive transmission. The motor frame 103 for the motor 104 is preferably 2×2×3/16" steel angle. The mount for motor preferably has at least 4" of adjustment.

Preferably the new direct drive motor would require only $1/3^{rd}$ hp providing 2800 pounds of torque for moving up to 12 rows of seats. Under previous systems, the motors would require 2 horsepower and 1200 pounds of torque to move up to 12 rows. For a telescoping seating system having up to 30 rows, previous systems required 5 horsepower motors providing 5900 pounds of torque, when in the present invention it is contemplated that with this design, only ¾ horsepower would be needed providing 7400 pounds of torque.

The drive shafts of the invention turn the drum. Preferred drive shafts are to be continuous 1 and ¼ inch OD cold rolled steel with flexible shaft couplings to link all drums and motors together. The shafts could be 1 inch to 1 and ⅝ inch or larger depending on the weight. At least 4 shaft couplers are shown, but depending on the length of the bleachers, more may be needed to connect the numerous shafts together.

This invention is contemplated for use in a wide variety of bleacher systems, from 3 to over 30 rows, and having a length of a mere 6 feet to over 180 foot lengths. For longer lengths, more drum units would be needed. It is considered that this invention would work easily with a system of up to 10 drum units, and even more, although the shaft diameters may have to be adjusted to handle the additional weight of the longer units.

Limit switches further control the motors. Limit switches are operably connected to the motor and are preferably fully enclosed with two operating cams. The limits of the limit switches are to be adjusted to stop bleachers automatically in the extended and closed positions based on certain preset values. Limit switches are to be operated off the drive shaft. Typical limit switches are available from Furnas such as NEMA 1 & 12 industrial use 54BB23FC, NEMA 4 water flight 54BB23EC, NEMA 7 & 9 54BB23HC.

There has thus been described a telescoping seating system having a plurality of benches wherein a direct drive motor is utilized to move the benches uniformly and simultaneously by retraction of a plurality of drive carriages which support the benches. While particular embodiments of the present invention have been shown and described, it will be apparent to those skilled in the art that changes and modifications may be made therein without departing from the invention and its broader aspects. For example, the present invention may be used with many different types of bench structures and is not limited to the seating structures described herein, as persons skilled in the art will appreciate. The appended claims, therefore, are intended to cover all such changes and modifications as fall within the true spirit and scope of the invention.

What is claimed is:

1. A non-friction telescopic seating system, comprising seats disposed on a frame, which is operably connected to a motor system;

a plurality of interconnected drive carriages adapted for connection to a telescopic seating system to extend and retract the telescopic seating system, said drive carriages being configured to selectively mateably wind onto and off from a drum as said drum is rotated;

a motor system comprising: a non-vertically moving drum operably anchored to a drum frame wherein said drum has at least two drum shafts rotatably engaged to said drum;

a direct drive power system operably attached to said drum frame further having a motor attached to a motor frame, at least two motor shafts extending from each side of said motor, and a drive shaft operably connected to said motor shafts; and a plurality of coupling means for coupling said drive shaft with one of said at least two drum shafts and one of said at least two motor shafts thereby enabling said motor to rotate said drum and thereby extend and retract drive carriages which move said seats, and wherein said motor and drum engage said drive carriages so that said drive carriage move in substantially continuously tangentially alignment as said drive carriages are selectively retracted and extended by said drum.

2. The non-friction telescopic seating system of claim 1, wherein said drum is at least six sided with each side having 2 flat members per side where each flat members is connected to the other member at an angle of between 45 and 90 degrees.

3. The non-friction telescopic seating system of claim 1, wherein said motor has a horse power rating of no more than ¾ hp for use with up to 30 rows of seats.

4. The non-friction telescopic seating system of claim 1, wherein said drive carriages are interconnected with hinges and have a length sufficient to extend a telescoping seating system to about 30 rows.

5. The non-friction telescopic seating system of claim 1, where said drive carriages are detachably connected at one end to said drum, and wherein said drive carriages wrap on said drum, nesting adjacent to each other in an alternating arrangement when a plurality of interconnected links are wound onto said drum.

6. The non-friction telescopic seating system of claim 1, further including limit switches operatively connected to said direct drive power system to limit the maximum travel of the drum, and thereby limit the distance traveled by said drive carriages as they are wound about said drum.

7. The non-friction telescopic seating system of claim 6, wherein said drive carriages each includes at least one wheel for supporting each of said drive carriages moveably on a surface.

8. The non-friction telescopic seating system of claim 1, wherein the drive shaft is made of iron, steel or a combination thereof.

9. The non-friction telescoping seating system of claim 1, wherein said motor is a single motor.

* * * * *